US005856599A

United States Patent [19]

Kuroki

[11] Patent Number: 5,856,599

[45] Date of Patent: Jan. 5, 1999

[54] PROCESS FOR CONTINUOUSLY PREPARING OIL FROM WASTE PLASTICS AND APPARATUS THEREFOR

[75] Inventor: Takeshi Kuroki, 2-12-7, Aoshima, Miyazaki 889-21, Japan

[73] Assignees: Takeshi Kuroki; Nippo Ltd., both of Japan

[21] Appl. No.: 700,499

[22] PCT Filed: Dec. 22, 1995

[86] PCT No.: PCT/JP95/02643

§ 371 Date: Aug. 26, 1996

§ 102(e) Date: Aug. 26, 1996

[87] PCT Pub. No.: WO96/20254

PCT Pub. Date: Jul. 4, 1996

[30] Foreign Application Priority Data

Dec. 27, 1994 [JP] Japan ..... 6-324855

[51] Int. Cl.[6] ..... C07C 1/00; C10G 1/00; C10B 7/10; C10B 35/00

[52] U.S. Cl. ..... 585/241; 585/950; 201/2.5; 201/25; 202/118; 422/189; 422/193; 196/107; 196/110; 208/72

[58] Field of Search ..... 589/241, 648, 589/650; 585/950; 201/2.5, 25; 208/72; 196/107, 110; 422/189, 193; 202/118

[56] References Cited

U.S. PATENT DOCUMENTS

| | | | |
|---|---|---|---|
| 3,947,256 | 3/1976 | Tsukagoshi et al. | 44/50 |
| 4,235,676 | 11/1980 | Chambers | 202/118 |
| 4,350,663 | 9/1982 | MacAlister | 422/137 |
| 5,639,937 | 6/1997 | Hover et al. | 585/241 |

FOREIGN PATENT DOCUMENTS

| | | |
|---|---|---|
| 2300124 | 10/1976 | France . |
| 2600530 | 8/1976 | Germany . |
| 47-42968 | 12/1972 | Japan . |
| 48-95478 | 12/1973 | Japan . |
| 51-93909 | 8/1976 | Japan . |
| 51-108003 | 9/1976 | Japan . |
| 53-18463 | 5/1978 | Japan . |
| 5-263079 | 10/1993 | Japan . |
| 1547961 | 7/1979 | United Kingdom . |
| 1547962 | 7/1979 | United Kingdom . |

*Primary Examiner*—Bekir L. Yildirim
*Attorney, Agent, or Firm*—Klauber & Jackson

[57] ABSTRACT

A technique of preparing oil from waste plastics, especially the one to which a mechanism of an extrusion molding machine is applied, is provided wherein an effective control of a decomposition process is conducted in order to effectively prevent the generation of carbon and to efficiently obtain recovered products having a desired composition. For this purpose, reactors 1*a*, 1*b*, and 1*c* having built in carrying means 3*a*, 3*b*, and 3*c*, respectively are used as connected in stages, in which reactors waste plastics are heated and decomposed into oil as carried. One or a series of reactors are used as a unit to form a melting zone and a decomposing zone in the carrying direction. In the melting zone the waste plastics in the solid form is melted and liquefied, and in the decomposing zone, the liquefied components supplied from the melting zone is allowed to form a shallow liquid phase section at the bottom of the reactors, and at the same time the gasified components evolved from the liquid phase section is allowed to form a gas phase section having a sufficiently large volume as compared with that of the liquid phase on top of the liquid phase section, the gasified components filling the gas phase section is guided to the outside and cooled, and then recovered as an oil.

7 Claims, 2 Drawing Sheets

PROCESS FOR CONTINUOUSLY PREPARING OIL FROM WASTE PLASTICS AND APPARATUS THEREFOR

TECHNICAL FIELD

The present invention relates to a technique of preparing oil by thermally decomposing waste plastics, and more particularly to a technique of efficiently preparing an oil product having a composition highly suitable as a fuel oil for industrial burners etc.

BACKGROUND OF THE INVENTION

Although various ideas and modes of apparatus have been proposed to prepare oil from waste plastics, it is a matter of fact that none of them have been operationally practicable.

By way of example, there is a technique of applying the mechanism of an extrusion molding machine, the technique comprising continuously conducting thermal decomposition of waste plastics into oil under heat while continuously carrying them by a continuous carrying means like a screw conveyer which Is characteristic of the extrusion molding machine. In applying the mechanism of the extrusion molding machine, the extrusion molding machine, being a highly established technology, has been highly expected that a resultant machine in a compact form will have a relatively large throughput, and will permit continuous automatic processing. Therefore, many researches and developments have been conducted all over the world, but no machine has been yet put into practice as mentioned before.

One of the major reasons why the conventional technology of preparing oil including the method of extrusion molding is the evolution of a large quantity of carbon in the decomposition process. Carbon generated in large quantity will attach to the inner wall of a decomposition reactor and thereby inhibits heat transfer and renders a stable control of the decomposition reaction difficult. As a result, recovered products having a desired composition cannot be efficiently obtained. Furthermore, since a great deal of efforts and time are required and the reaction processes become increasingly dangerous, many supervisory personnel are required. As a result, the machine will be economically poor and, therefore, cannot be operated as a practical machine.

In addition, insufficient controllability of the recovered products is also an obstacle to practical use. Although the recovered products preferably has a constituent composition suitable as a fuel oil for industrial burners etc., the recovered products by conventional techniques have a reduced quality due to contamination of carbon, or not suitable as a fuel oil due to contamination of too much gasoline derived from over-decomposition. It is, therefore, impossible to enhance the added value for practical operation of a system, and thus the recovered products cannot be applied for the operation of a practical system.

In order to prevent evolution of carbon and to control the composition of the recovered products which are required for realizing practical operation of preparing oil, exact knowledge on the mechanism of polymer decomposition and carbon evolution and proper countermeasures based on the information should be required. In this regard, however, the conventional technologies have been insufficient, and they can neither effectively prevent the evolution of carbon nor effectively control the composition of the recovered products.

From the above standpoint, the inventor conducted a thorough research and analysis on the mechanism of polymer decomposition and carbon evolution, and obtained the following findings. First, the decomposition of a polymer into oil was found to take place in the following processes: the solid material is melt and liquefied, which is then heated in the liquefied state to decompose the higher structure of the polymer to a lower structure, and then at this state decomposition starts for the first time, which causes the evolution of gasified components having different molecular weights depending on different decomposition temperatures, and the gasified components is cooled to yield a recovered product having a fixed composition. The composition of the recovered product is most significantly affected by the control of the heating temperature and the decomposition reaction in the liquid state. Therefore, the control of the heating temperature and the decomposition reaction for the liquid state Is most important for the resultant composition of the recovered product.

Carbon is mostly generated when the gasified components evolved in decomposition, especially those in which low molecular weight components are more predominant, are excessively heated. All the conventional processes are conducted under the conditions in which the gasified components cannot be free from the excessive heating because they are contained or trapped in the solid materials and the liquefied components, which is the biggest reason for the generation of a large quantity of carbon. It is therefore most important that the gasified components evolved from the liquefied components be immediately separated from the latter so that the former may not be exposed to excessive heating.

Especially, in the conventional techniques employing a mechanism of the extrusion molding machine, the liquid components after liquefaction are conveyed in the compressed highly densed form due to the extrapolation of the idea in the molding field that the compressing power and the shear stress derived from the strong conveying by the screw should also be used as a heat source. As a result, the liquid components tend to be contained and cause the generation of a large quantity of carbon. Furthermore, since a thick layer is formed by a polymer having low thermal conductivity, the effective control of the temperature of its center becomes difficult, thus disenabling the effective control of the composition of the recovered product.

DISCLOSURE OF THE INVENTION

The purpose of the present invention which was made based on the above findings is to prepare oil from waste plastics, especially oil preparation technique which utilizes a mechanism of the extrusion molding machine and is expected to have the above-mentioned advantages, characterized in that an effective control o f the decomposition process is conducted in order to effectively prevent the generation of carbon and to efficiently obtain the recovered product having a de sired composition.

More specifically, the present invention provides a method of continuously preparing oil from waste plastics comprising one or a plurality of reactors connected in stages and having built in a carrying means which continuously carries sideways subject substance from a supply side to a discharge side in a horizontal or a slightly slanted state as appropriate, in which reactors, the waste plastics are heated and decomposed into oil as carried, wherein a melting zone and a decomposing zone are formed in the carrying direction defined by one or a series of reactors as a unit, in the melting zone the waste plastics in a solid form ia melt and liquefied, and in the decomposing zone the liquefied components supplied from the melting zone is allowed to form a shallow liquid phase section at the bottom of the reactors, and at the same time the gasified components derived from the decomposition and gasification of the liquefied components at the liquid phase section is allowed to form a gas phase section having a sufficiently large volume as compared with that of the liquid phase section on top of the liquid phase section, then the gasified components filling the gas phase section is guided to the outside and cooled, and is finally recovered as an oil.

The method is characterized in that a liquid phase section and a gas phase section are formed in the decomposing zone wherein a sufficiently large volume is allocated to the gas phase section compared to the liquid phase section, while the liquid phase section is formed thin. As a result, the effect due to the low conductivity of the polymer can be reduced so that the temperature control of liquefied components in the liquid phase section is facilitated and the recovered product with a desired composition can be-easily obtained. Furthermore, it is also possible to quickly separate the gasified components obtained from the liquefied components so as to prevent the gasified components from being exposed to excessive heat, thereby effectively preventing the evolution of carbon. Since the evolution of carbon is effectively prevented, stable control of the decomposition reaction is facilitated to efficiently prepare the recovered product with a desired composition, to greatly reduce the burden of maintenance of the apparatus, and to practically eliminate the monitoring of the reaction process, which leads to realization of unmanned operation.

Such gas phase section also serves to effectively control the composition of the recovered product. Particularly, keeping the temperature in the gas phase section lower than that of the liquid phase section can generate a spontaneous convection of the gasified components in the gas phase section. Due to this convection, only the large molecular weight components return to the liquid phase section to undergo decomposition again into small molecular weight components, thus allowing to keep the molecular weight distribution of the recovered product in a narrow range.

In order to effectively utilize the above mechanism, the gas phase section is provided with enough volume to permit effective generation of spontaneous convection of the gasified components as described above, and the heating control at the gas phase section is separated from that at the liquid phase section in order to maintain the temperature of the gas phase section lower than that in the liquid phase section.

In accordance with the invention, the liquefied components are brought into contact with a catalyst in the liquid phase section as the above-mentioned separation of the liquid phase section from the gas phase section takes place. Thus, the contact of only the liquefied components with a catalyst in the liquid phase section is also important for control of the decomposition reaction under the liquefied state as described above, and contributes a great deal to attaining a desired composition of the recovered product. This point is further explained below in comparison with the conventional methods of using catalyst.

The conventional idea assumed that the catalyst works only in the gas phase, and thus the gasified components generated from the decomposition was brought into contact with the catalyst resulting in an excessive decomposition leading to generation of a large quantity of gasoline. Thus, in the conventional methods, no catalyst has been practically used in the oil preparation and decomposition process in an essential meaning, but the catalyst was used in secondary processes after the decomposition, which was responsible for modifying the composition of the recovered product into an undesirable direction. On the other hand, in the present invention the catalysts is used in the oil preparation and decomposition process in an essential meaning, and the action can be used only for the decomposition, in other words the catalyst can be reacted not to the gasified components derived from the decomposition but only to the liquefied polymer, with the result that decomposition efficiency can be greatly increased and the recovered product with a desired composition can be obtained in a high efficiency.

The continuous oil preparing apparatus for realizing the continuous method described above of preparing oil has a basic structure comprising one or a plurality of reactors connected in stages and having built in a carrying means which continuously carries the subject substance from the supply side to the discharge side in a horizontal state, in which reactors the waste plastics are heated and decomposed into oil as carried wherein a melting zone and a decomposing zone are formed in the carrying direction defined by one or a series of reactors as a unit. In the melting zone, the waste plastics in a solid form is melt and liquefied, and in the decomposing zone the liquefied components supplied from the melting zone is allowed to form a shallow liquid phase section at the bottom of the reactors, and at the same time the gasified components derived from the decomposition and gasification of the liquefied components at the liquid phase section is allowed to form a gas phase section having a sufficiently large volume as compared with that of the liquid phase section on top of the liquid phase section. The gasified components filling the gas phase section is guided to the outside and cooled, and is finally recovered as an oil. At a site corresponding to the above decomposing zone, this apparatus is provided with a carrying means for carrying the gasified components in the liquid phase section in close proximity to the bottom of the reactor, and with on the carrying means a space for the above gas phase section.

MODE FOR CARRYING OUT THE INVENTION

Figure 1:
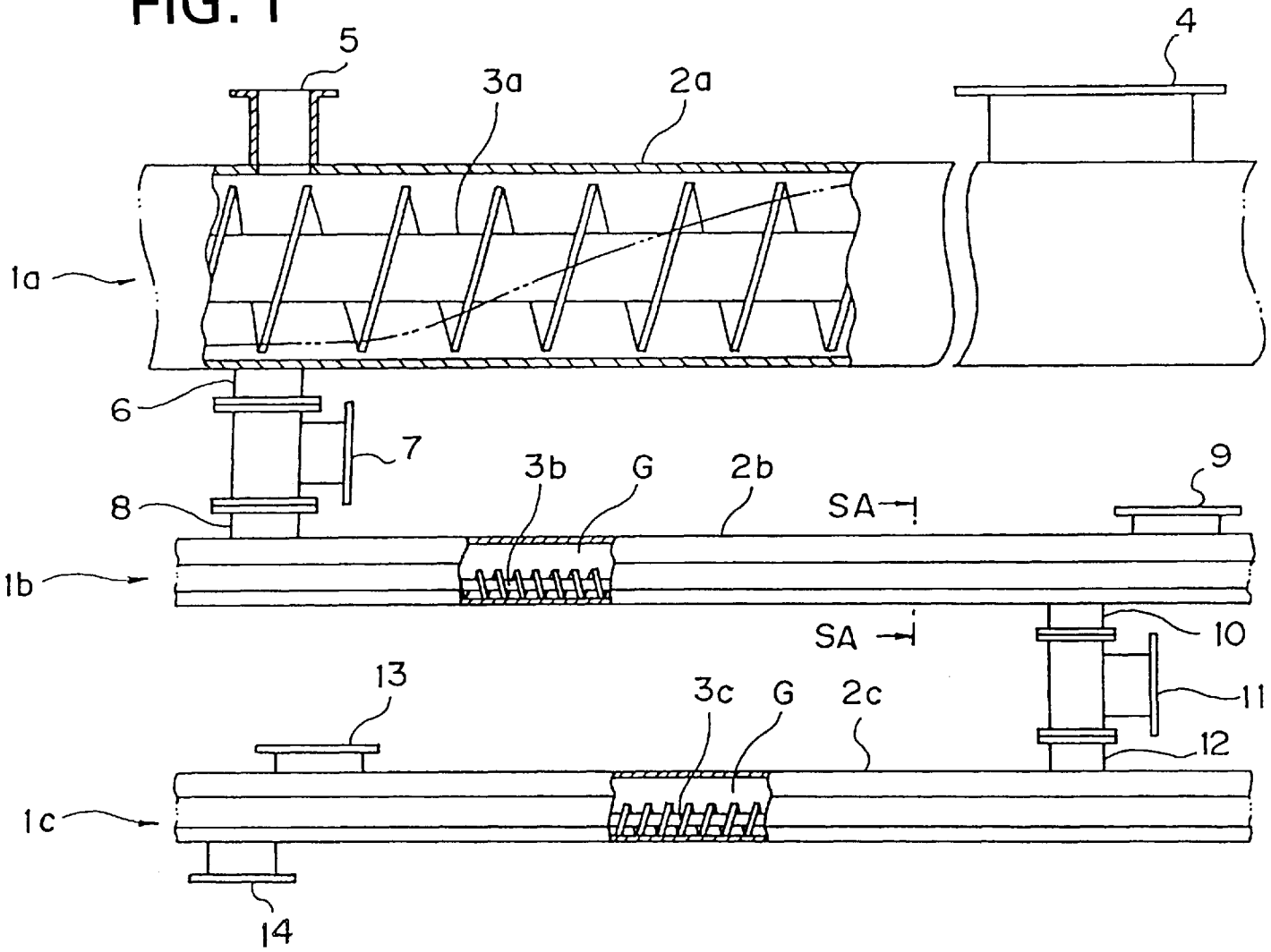
FIG. 1 shows a schematic side view of the essential part of the continuous oil preparing apparatus of an embodiment of the present invention.

An embodiment of the invention will be described below. In an embodiment of the present invention, a continuous oil preparation apparatus as shown in FIG. 1 is used. The continuous oil preparation apparatus comprises three reactors 1*a*, 1*b*, and 1*c* connected in stages in a vertical direction. Reactors 1*a*, 1*b*, and 1*c* have a double-spindle screw 3*a*, 3*b*, and 3*c* as a carrying means in a cylindrical casing 2*a*, 2*b*, and 2*c*, respectively. Each reactor 1*a*, 1*b*, and 1*c* can be heated by a respective external heating means (not shown in the figure).

For the upper reactor 1*a*, the inner periphery of the casing 2*a* is slightly larger than the outer periphery of the s crew 3*a*. Near one end of the casing 2*a*, a feed section 4 is provided, and near the other end is provided a first gas vent 5 and an outlet 6, which outlet 6 is connected to an inlet 8 of the reactor 1*b* in the middle stage, with a second gas vent 7 interposed between the inlet 8 and outlet 6.

Figure 2:
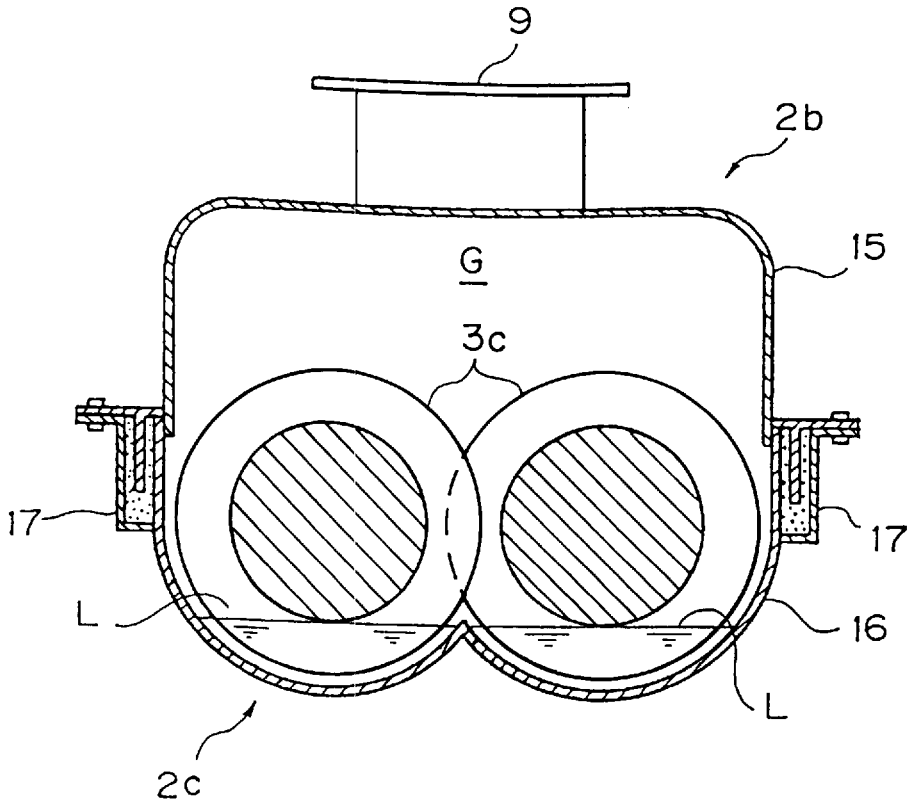
FIG. 2 shows a cross sectional view along the line SA—SA in FIG. 1.

On the other hand, for the reactors 1*b* and 1*c* in the middle and the bottom stage, respectively, the height of the casings 2*b* and 2*c* are about one third that of the casing 2*a* of the reactor 1*a* in the upper stage. And the screws 3*b* and 3*c* which have a height about half that of the casings 2*b* and 2*c* are situated along the bottom of the casings 2*b* and 2*c*. As a result, a space having a certain volume is formed as a gas phase G on top of the screws 3*b* and 3*c*. In addition to the above inlet 8, the reactor 1*b* in the middle stage is equipped with a third gas vent 9 and an outlet 10 near each end of the casing 2*b*. The reactor 1*c* in the lower stage is equipped with an inlet 12 connected to the outlet 10 of the reactor 1*b* in the middle stage mediated by a fourth gas vent 11 near one end of the casing 2*c*, and is equipped with a fifth gas vent 13 and an outlet 14 near the other end. Furthermore, as shown for the reactor 1*b* in the middle stage in FIG. 2, the casings 2*b* and 2*c* of the reactors 1*b* and 1*c* are formed by an upper casing member 15 and a lower casing member 16, which members 15 and 16 are connected to a connection port 17 having an air tight structure.

To each reactor 1*a*, 1*b*, and 1*c* is connected a drive system which drives and rotates the screw 3*a*, 3*b*, or 3*c*, respectively. Since the system is of the conventional type, it is not shown in the figure.

The continuous oil preparation from waste plastics with this continuous oil preparation apparatus is conducted as follows: From a introduction section 4 of the reactor 1*a* in the upper stage is continuously supplied waste plastics in the solid form which were subjected to a predetermined pulverization treatment in mixture with a granular catalyst such as silica particles. This is gradually melt and liquefied under heat while being carried by the screw 3*a*. This distance constitutes a melting zone which occupies about 80% of the actual length of 2 m of the reactor 1a in the upper stage.

At the end of the melting zone, the liquefied components having low viscosity become predominant and cluster with the catalyst to form thin layers of a few centimeters at the bottom of the casing 2*a* (the alternate long and two short dashes line in FIG. 1 indicates the waste plastics in the solid form which is in the process of being melt and liquefied and decreasing its volume to become thin layers). This site represents an initial decomposing zone which links the melting zone with the decomposing zone described below, where decomposition and gasification of the liquefied components gradually begin, and the evolved gasified components are discharged from the first gas vent 5 into the recovery apparatus outside the figure, and cooled and recovered.

The low-viscous liquefied components from the initial decomposing zone flow through the outlet 6 and the inlet 8 down to the reactor 1*b* in the middle stage. The reactor 1*b* in the middle stage is combined with the reactor 1*c* connected to in the lower stage forms the decomposing zone. The liquefied components which was discharged to the reactor 1*b* in the middle stage or the decomposing zone are carried by the screw 3*b* to the side of the outlet 10 in the state of a shallow liquid phase L which was formed at the bottom of the casing 2, and while being carried the liquefied components is subjected to heating at a heating temperature at the liquid phase L (for example, about 450° C. for polystyrene and about 600° C. for polyethylene) and thereby decomposed to release the gasified components into the gas phase G.

In the gas phase G, although the low molecular weight components among the gasified components are light, they are discharged from both the second gas vent 7 and the third gas vent 9, the high molecular weight components are cooled in the gas phase G in an atmosphere of the temperature controlled to be lower (for example, about 300° C. for polystyrene and about 450° C. for polyethylene) than the liquid phase L and fall down to the liquid phase of higher temperature, where they are heated and decomposed again to become low molecular weight components. In other words, in the gas phase G, due to the difference from the temperature of the liquid phase, active vertical convection of the gasified components arise to facilitate the reduction of high molecular components.

The above-mentioned reactions take place in a completely same manner at the reactor 1*c* in the lower stage for the gasified components which was discharged from the reactor 1*b* in the middle stage. Finally, non-decomposed substances are discharged from the outlet 14 of the reactor 1*c* in the lower stage and recovered.

The oil products thus obtained had, as the major components, a component corresponding to kerosene, a component corresponding to light oil, and a component corresponding to A heavy oil, and thee ratio of components reaches 98% in the case of polystyrene to have a composition suitable as an industrial burner fuel.

With the structure based on the embodiment of the present invention described above, a specific example in which a throughput of 60 kg/hr is expected has the following structure: For the reactor 1a in the upper stage, the casing 2*a* is about 22 cm in height and about 3 m in whole length; and the casings 2*b* and 2*c* for the reactors 1*b* and 1*c* in the middle and the lower stage respectively have a height about one-third that of the reactor 1*a* in the upper stage, and a total length is slightly shorter than the reactor 1*a* in the upper stage, constituting a very compact structure.

INDUSTRIAL APPLICABILITY

As described above, the present invention can eliminate such problems as carbon generation and the control of quality of the recovered oil in the technology of oil preparation utilizing the extrusion molding mechanism, and permits a practical operation of the continuous oil preparation technology which makes the best use of the advantages of the compact size of the overall apparatus and the continuous automatic processing by application of the extrusion molding mechanism.

I claim:

1. A method for continuously preparing oil from solid waste plastics which comprises heating the waste plastics in a single reactor or a plurality of reactors connected in stages so as to decompose the waste plastics into liquefied components and gasified components, said reactor or reactors comprising a single tubular member or a plurality of tubular members connected in stages and provided with a carrying means located eccentrically downward from a center axis in said tubular member or members, said tubular member or members containing a melting zone having an empty space in order to overheat vaporized waste plastics to prevent the generation of carbon therefrom, and a decomposing zone formed therein in the direction of flow of the waste plastics through the tubular member or members, said waste plastics being melted and liquified in said melting zone and thereafter decomposed in said decomposition zone to form a liquid phase section comprising said liquified components at the bottom of the tubular member or members and a gas phase section comprising said gasified components located on top of said liquid phase, said gasified components being discharged from the tubular member or members, cooled and thereafter recovered as said oil.

2. The method of claim 1 wherein the temperature in the gas phase section is lower than the temperature present in the liquid phase section.

3. The method of claim 2 wherein the liquified components are brought into contact with a catalyst.

4. The method of claim 1 wherein the liquified components are brought into contact with a catalyst.

5. The method of claim 1 wherein the carrying means comprises an extrusion molding machine provided with a screw conveyor.

6. An apparatus for continuously preparing oil from solid waste plastics by heating the waste plastics so as to decompose them into liquified components and gasified components, which comprises a single reactor or a plurality or reactors connected in stages, said reactor or reactors comprising a single tubular member or a plurality of tubular members connected in stages and containing a carrying means for continuously carrying the waste plastics from a supply side to a discharge side, said tubular member or members containing a melting zone having an empty space in order to overheat vaporized waste plastics to prevent the generation of carbon therefrom, and a decomposing zone formed therein in the direction of flow of the waste plastics through the tubular member or members, such that the wasteplastics are melted and liquified in said melting zone and thereafter decomposed in said decomposition zone to form a liquid phase section comprising said liquified components at the bottom of the tubular member or members and a gas phase section comprising said gasified components located on top of said liquid phase, said gasified components being discharged from the tubular member or members, cooled and thereafter recovered as said oil, said carrying means being provided at a site corresponding to said decomposition zone and located eccentrically downward from a center axis of the tubular member or members for carrying the liquified components in close proximity to the bottom of the tubular member or members, said carrying means also being provided with a space to contain the gas phase section.

7. The apparatus of claim 6 wherein the carrying means comprises an extrusion molding machine provided with a screw conveyor.

* * * * *